US007651300B2

(12) United States Patent
Carlson

(10) Patent No.: US 7,651,300 B2
(45) Date of Patent: Jan. 26, 2010

(54) SLIDE RAIL PANEL PUSHING ASSEMBLY

(75) Inventor: Gary Richard Carlson, St. Paul, MN (US)

(73) Assignee: Pro-Tec Equipment, Inc., Charlotte, MI (US)

( * ) Notice: Subject to any disclaimer, the term of this patent is extended or adjusted under 35 U.S.C. 154(b) by 501 days.

(21) Appl. No.: 11/508,663

(22) Filed: Aug. 23, 2006

(65) Prior Publication Data

US 2008/0050183 A1 Feb. 28, 2008

(51) Int. Cl.
*E02D 7/02* (2006.01)
*E02D 13/02* (2006.01)

(52) U.S. Cl. ..... 405/232; 405/303; 173/45; 254/134

(58) Field of Classification Search ..... 405/282, 405/232, 272, 283, 303; 173/45; 254/134
See application file for complete search history.

(56) References Cited

U.S. PATENT DOCUMENTS 3,001,515 A * 9/1961 Haage ..... 173/125
3,712,389 A 1/1973 Smoak
3,927,861 A * 12/1975 Dumont ..... 254/29 R
4,058,983 A 11/1977 Griswold
4,709,764 A * 12/1987 Gibbons ..... 173/45
5,277,522 A 1/1994 Pertz

* cited by examiner

*Primary Examiner*—Tara Mayo-Pinnock
(74) *Attorney, Agent, or Firm*—Dickinson Wright PLLC; Harold W. Milton, Jr.

(57) ABSTRACT

A panel pushing assembly (10) for a slide rail system having a first and second wall (12, 14) includes an elongated member (16) having a bottom end (18) and a top end (20), and a guide (40) disposed about the elongated member (16). The guide (40) guides slidable movement along the elongated member (16) and includes a collar (42) engaging the walls (12, 14) of the elongated member (16) and a catch (44) extending laterally from the collar (42) to engage the second wall (14), which is the stationary wall. The collar (42) includes a plurality of side-plates (46) and the catch (44) includes a hook portion (70) extending downwardly along the outside of the second wall (14) for preventing lateral movement of said elongated member (16) relative to the second wall (14). A retention finger (34) is disposed on the bottom end (18) of the elongated member (16) for preventing lateral movement of the bottom of the elongated member (16) and a head-plate (28) is disposed on the top end (20) of the elongated member (16) to receive a pushing force (F).

19 Claims, 4 Drawing Sheets

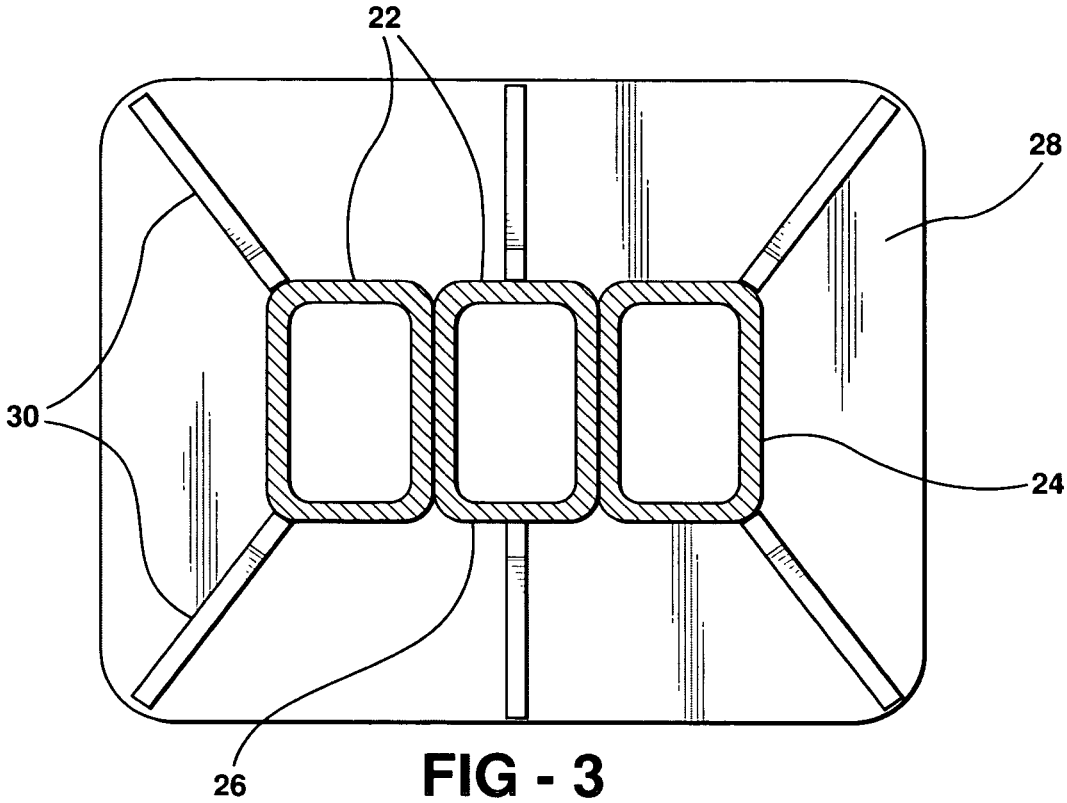
FIG - 3
FIG - 4
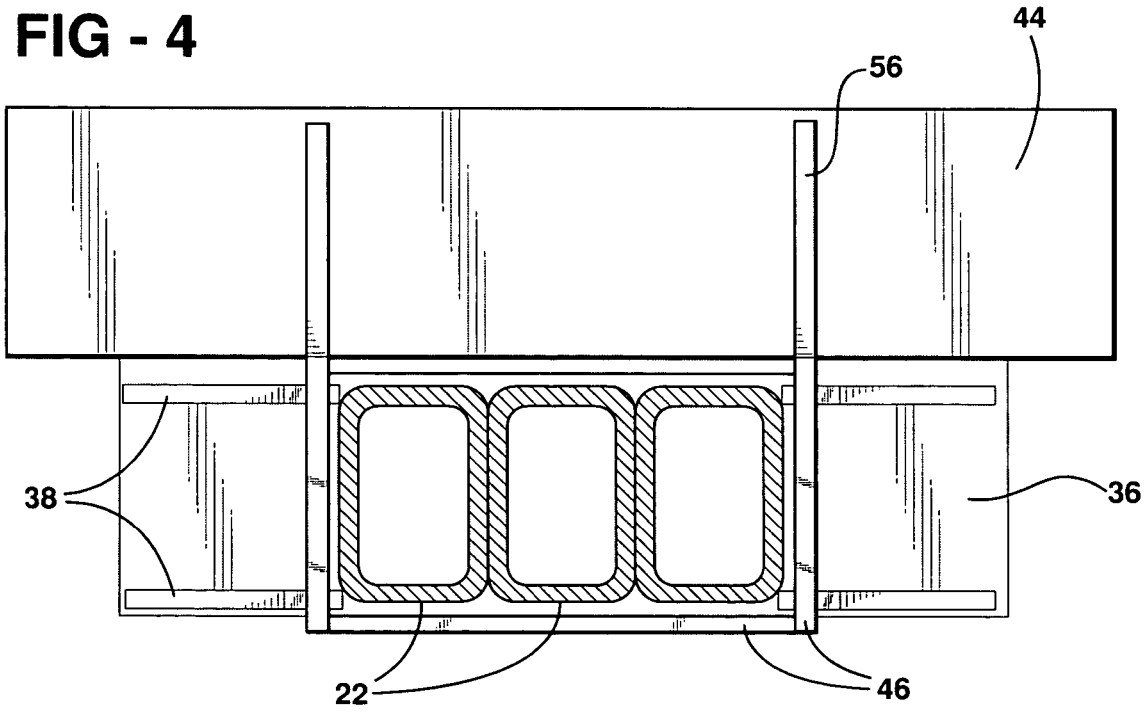

SLIDE RAIL PANEL PUSHING ASSEMBLY

BACKGROUND OF THE INVENTION

1. Field of the Invention

The subject invention relates to a panel pushing assembly for pushing the first wall into the ground of a slide rail system having multiple walls.

2. Description of the Prior Art

One known problem encountered while pushing a slide rail panel into the ground is damage to the wall due to exerting a force directly on the top of the wall. One solution is reinforcement of the top of the wall; however these modifications increase the cost of each slide rail panel. An example of such an assembly is U.S. Pat. No. 5,277,522 to Pertz.

The Pertz patent discloses a single-walled trenching assembly including a head-plate, releasably mounted along the length of the top of a slide rail panel. The top of the wall is a channel beam having side flanges. The head-plate is an inverted U-shaped channel member having a top surface no greater than that of the top of the wall wherein it sits. The head-plate releasably engages the top channel via a tight fit with rods that are welded to the inside walls of the flanges on the top channel of the wall.

There is a further problem specific to multi-wall slide rail systems. The force exerted on the walls is usually applied using the bucket of an excavator, excavating crane, or trencher. The inside wall or walls, namely a center wall and inside wall in a triple track slide rail system, are difficult to reach without having to move the excavator. Furthermore, the only way to exert a force to all of the walls is to use the teeth of the bucket to push the inside or center wall which causes more damage to the wall.

Although the prior art panel pushing assemblies serve the purpose of protecting the top of the wall while pushing the wall into the ground, there remains a need for a tool to push a slide rail panel that can be moved from one slide rail panel to another eliminating the need to reinforce each individual slide rail panel. Specifically there remains an opportunity for a panel pushing assembly which provides a heightened yet stable position for conveniently applying a downward force to the first wall of a multi-walled slide rail system while simultaneously protecting the top of the first wall.

SUMMARY OF THE INVENTION AND ADVANTAGES

The invention provides a panel pushing assembly comprising an elongated member having a longitudinal axis extending between a bottom end for engaging the top of the first wall and a top end for receiving the pushing force. The assembly is characterized by a guide member for engaging the top of the second wall and slidable along the elongated member for guiding longitudinal movement of the elongated member in response to the pushing force being applied to push the top end of the elongated member into the ground.

Accordingly, a panel pushing assembly is provided for use with a slide rail system having a first and second wall wherein a guide provides stability by engaging the second wall which is stationary, while the first wall is being pushed into the ground. The assembly protects the top of the first wall from damage that may occur when applying the downward force directly on the first wall and allows the force to be applied at a more convenient vertically spaced location above the first wall. Additionally, the assembly can be removed and placed on many different slide rail panels, including both double track and single track slide rail systems, eliminating the need to reinforce each wall.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 3 is a cross-sectional view taken along line 3-3 of FIG. 2;

FIG. 4 is a cross-sectional view taken along line 5-5 of FIG. 2.

DETAILED DESCRIPTION OF THE INVENTION

Referring to the Figures, wherein like numerals indicate corresponding parts throughout the several views, a panel pushing assembly 10 is generally shown for pushing the first wall 12 into the ground of a slide rail system having a second wall 14.

Figure 1:
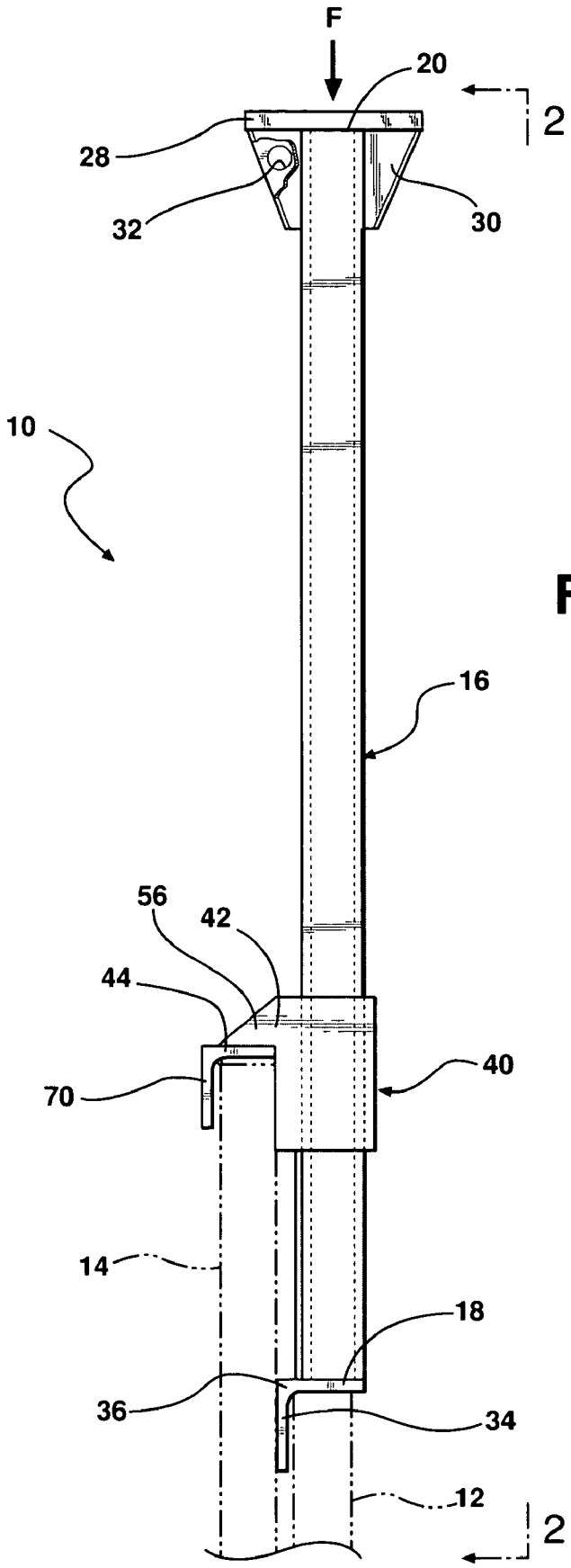
FIG. 1 is a side view of an embodiment of a panel pushing assembly.
Figure 2:
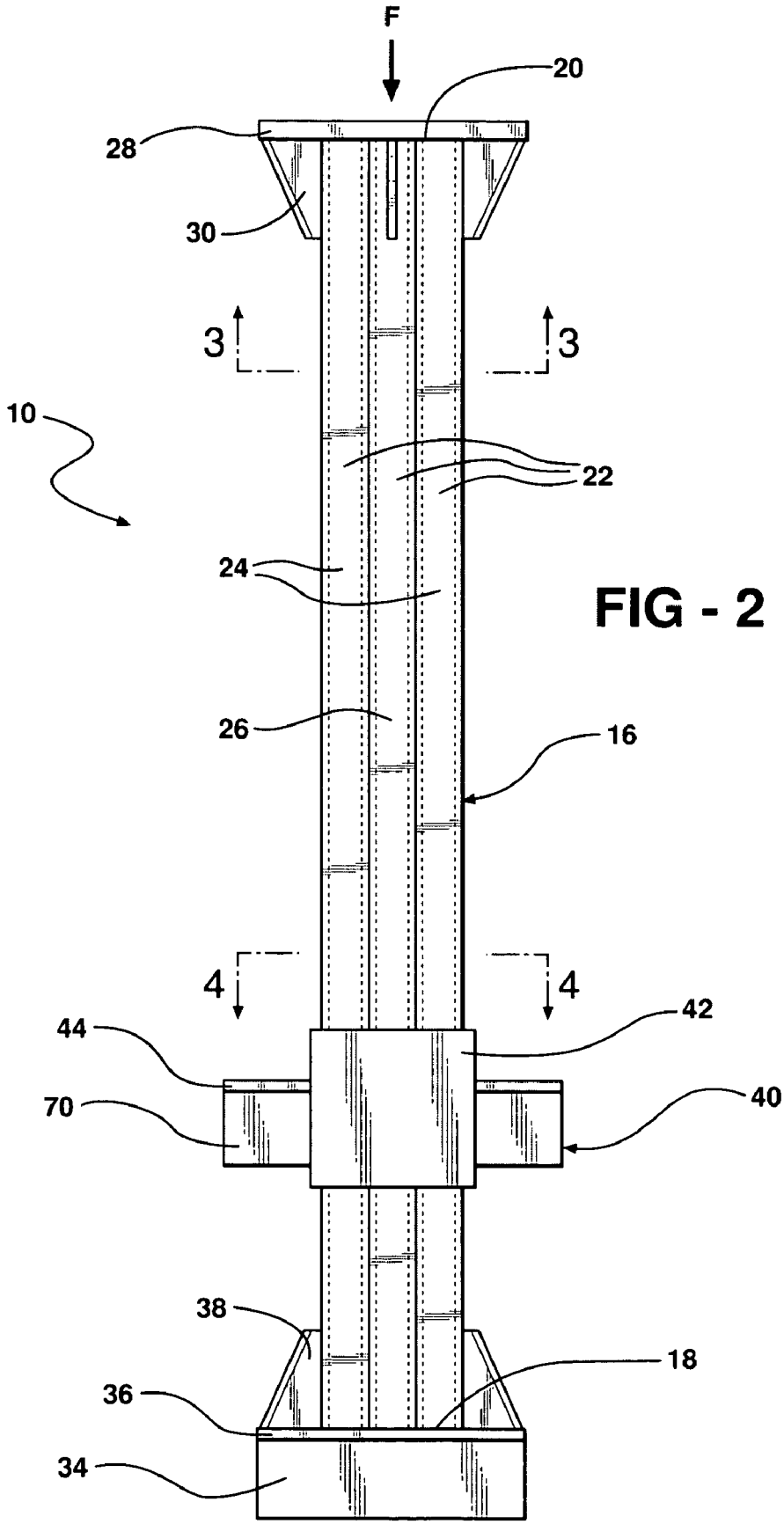
FIG. 2 is a front view taken along line 2-2 of FIG. 1.

The assembly 10 includes an elongated member 16 generally indicated having a longitudinal axis extending between a bottom end 18 for engaging the top of the first wall 12 and a top end 20 for receiving a pushing force F. The elongated member 16 includes a plurality of tubes 22 abutting one another to define a cross section having a rectangular periphery. The dashed lines in FIGS. 1 and 2 indicate the inside wall of the tubes 22. The plurality of tubes 22 includes two outside tubes 24 and one middle tube 26. Each tube 22 is hollow with a cross section having a rectangular periphery with rounded corners and the tubes 22 abut one another along the long side thereof and are welded together to define the elongated member 16.

A head-plate 28 is disposed on and extends radially both transversely and laterally from the top end 20 of the elongated member 16 for receiving a force F. The head-plate 28 is a rectangular metal plate having rounded corners and is welded onto the elongated member 16.

A plurality of first triangular shaped gussets 30 are disposed under the head-plate 28 and interconnect the elongated member 16 and the head-plate 28. The first gussets 30 are positioned at each corner of the elongated member 16 and in the center of each long side of the elongated member 16. In other words, a first gusset 30 is disposed at each of the two outside corners of the two outside tubes 24 and a first gusset 30 is disposed at each of the two short sides of the middle tube 26 of the elongated member 16. The perpendicular edges of each first gusset 30 are welded to the head-plate 28 and the elongated member 16.

An attachment 32 is disposed adjacent to the top end 20 of the elongated member 16 for lifting the assembly 10. The attachment 32 is defined by one of the first gussets 30 having a through-hole. Alternatively, the attachment 32 may be a U-shaped brace and may be positioned on the head plate, a first gusset 30 or the elongated member 16.

A retention finger 34 is disposed on and extends downwardly from the bottom end 18 of the elongated member 16 for disposition between the walls 12, 14. The retention finger 34 engages the interior of the first wall 12 and prevents radial movement of the bottom end 18 off of the top of the first wall 12. The retention finger 34 also extends radially of the longitudinal axis in a lateral direction outwardly of the elongated member 16 for extending along and engaging the second wall 14.

A flange 36 is disposed under the bottom end 18 of the elongated member 16. The flange 36 supports the retention finger 34 along side of the elongated member 16 and extends radially of the longitudinal axis in a lateral direction outwardly of the elongated member 16. A plurality of second triangular shaped gussets 38 are disposed on the flange 36 and interconnect the flange 36 and the elongated member 16. Two second gussets 38 are disposed on each of the distal ends of the flange 36, wherein the perpendicular edges of the second gussets 38 are welded to the elongated member 16 and to the top of the flange 36.

The assembly 10 is characterized by a guide member 40 generally indicated for engaging the top of the second wall 14 and for guiding longitudinal movement of the elongated member 16 in response to the pushing force F being applied to push the top end 20 of the elongated member 16 to push the first wall 12 into the ground. The guide 40 includes a collar 42 disposed about and slidable along the elongated member 16 and a catch 44 extending radially of the longitudinal axis in a transverse direction from the collar 42 for engaging the top of the second wall 14. The collar 42 includes a plurality of metal side-plates 46 that are welded to one another to form a rectangular-shaped collar 42 for engaging the rectangular elongated member 16.

Figure 5:
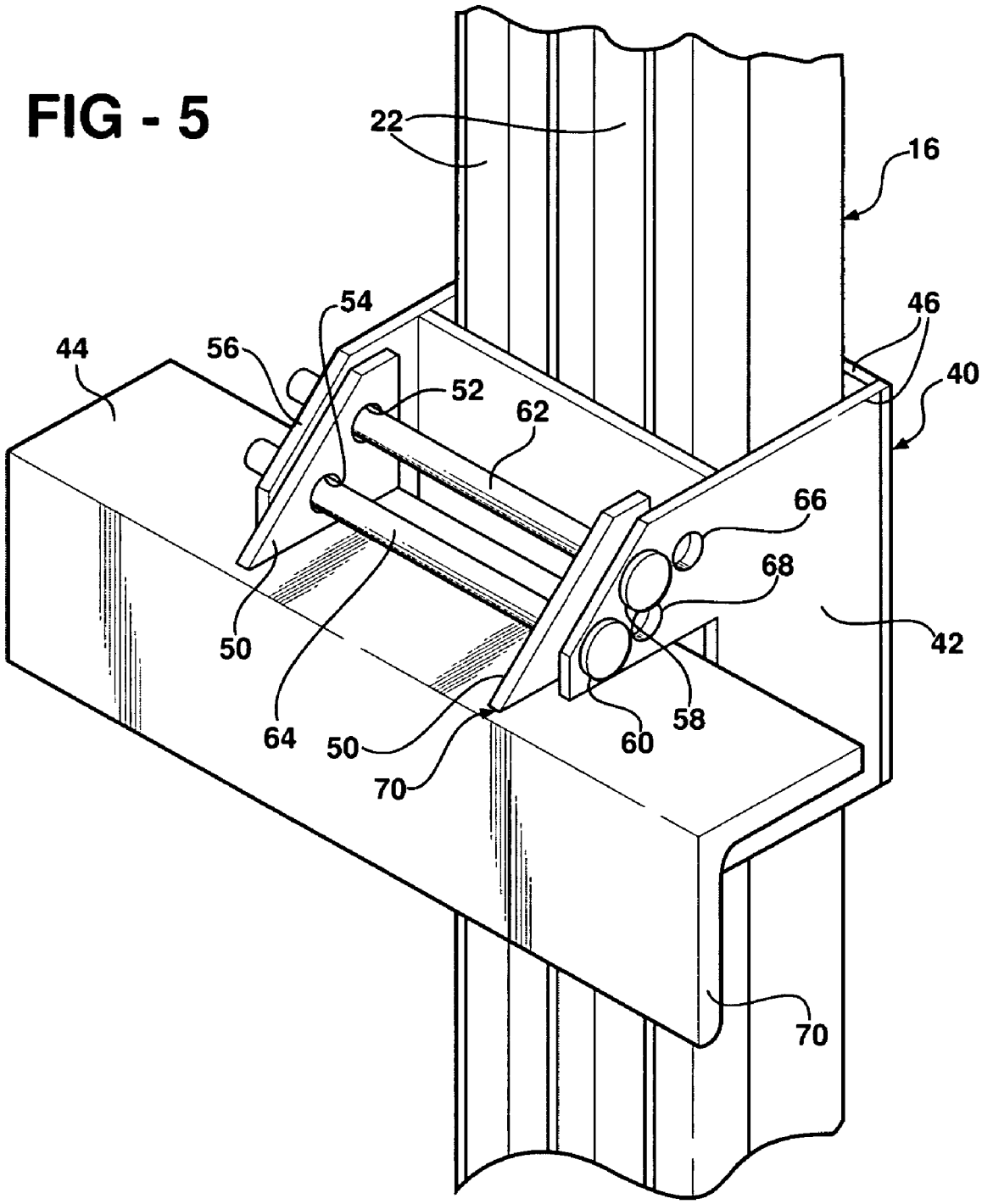
FIG. 5 is a perspective view partially cut away of an alternative embodiment of a panel pushing assembly illustrating an adjustable connection between the catch and the collar of the guide.

An adjustable connection 48 interconnects the catch 44 and the collar 42 for adjusting the catch 44 radially relative to the collar 42 to accommodate second walls 14 having different widths. One skilled in the art may appreciate many variations for the connection including a tongue and groove connection or a pin, as shown in FIG. 5.

The adjustable connection 48 includes a pair of catch flanges 50 spaced from one another and extending parallel to one another from the catch 44. Each of the catch flanges 50 define a top catch hole 52 and a bottom catch hole 54. The top catch holes 52 are axially aligned with one another and the bottom catch holes 54 are axially aligned with one another. The adjustable connection 48 also includes a pair of collar flanges 56 spaced from one another in the transverse direction and extending parallel to one another from the collar 42 for overlapping the catch flanges 50. The collar flanges extend radially from the side-plates 46 of the collar 42. Each of the collar flanges 56 define a first top collar hole 58 and a first bottom collar hole 60. The first top collar holes 58 are axially aligned with one another and the first bottom collar holes 60 are axially aligned with one another. As illustrated in FIG. 5, the catch 44 may be positioned such that the top catch holes 52 are laterally aligned with the first top collar holes 58 and the bottom catch holes 54 are similarly aligned with the first bottom collar holes 60.

The adjustable connection 48 includes a top pin 62 and a bottom pin 64. The top pin 62 is disposed through the first top collar holes 58 and the top catch holes 52 for interconnecting the catch 44 and the collar 42. The bottom pin 64 is disposed through the first bottom collar holes 60 and the bottom catch holes 54 for restricting rotational movement of the catch 44 relative to the collar 42. In FIG. 5, the pins 62, 64 are illustrated each being held in place by a cotter pin, however, one skilled in the art may appreciate that a variety of fasteners can be used including a nut and bolt or a snap pin.

Each of the collar flanges 56 define a second top collar hole 66 and a second bottom collar hole 68. The second top collar holes 66 are axially aligned with one another and radially spaced in a transverse direction from the first top collar holes 58. The second bottom collar holes 68 are axially aligned with one another and radially spaced in a transverse direction from the first top collar holes 58. The catch 44 may be adjusted by removing the pins 62, 64 from the first pairs of holes 60, 58, aligning the catch holes 52, 54 with the second collar holes 66, 68, and placing the pins 62, 64 through the respective second top and bottom holes 68, 66. The second collar holes 66, 68 are transversely spaced from the first collar holes 60, 58 at a predetermined distance for adjusting the catch 44 radially in a transverse direction to accommodate second walls 14 having two different widths. Likewise, multiple groups of holes can be similarly spaced in order to accommodate more than two different wall widths.

The catch 44 includes a hook portion 70 extending downwardly for preventing radial movement of the elongated member 16 relative to the second wall 14. The hook 70 also extends radially of the longitudinal axis in a lateral direction outwardly of the elongated member 16 for extending along and engaging the second wall 14. The catch 44 and the hook portion 70 may be defined by an angle iron welded to the side-plates 46 of the collar 42.

In operation, the assembly 10 is lifted by attaching a line or cable to the attachment 32 and thereafter the guide member 40 is lowered onto the second wall 14 of a slide rail system having a first and second wall 12, 14. The assembly 10 may be used on both a double track slide rail system having two walls 12, 14, and a triple track slide rail system having three walls 12, 14. With the double track system, the assembly 10 is lowered onto the wall referred as the inside wall. With the triple track system, the assembly 10 is lowered onto one of either a center wall or an inside wall. The elongated member 16 slides through the guide 40 to rest upon the first wall 12 of the multi-walled slide rail system. A pushing force F is applied to the head-plate 28 to push the bottom end 18 of the elongated member 16 engaging the first wall 12 to push the first wall 12 into the ground while the elongated member 16 slides through the guide 40 for providing stability. In use with a three-walled slide rail system, the assembly 10 may be placed on either of the two inside walls 12, 14, namely an inside wall or a center wall, in order to push either wall into the ground. To adjust the catch 44 and collar 42 for different sized second wall 14 widths, the pins 62, 64 may be removed, the catch 44 may be transversely adjusted to align the catch holes 52, 54 with the appropriate collar 42 holes, and the pins 62, 64 may be replaced through the catch holes 52, 54 and the corresponding collar holes.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

ELEMENT LIST

| Element Symbol | Element Name |
|---|---|
| 10 | driving post assembly |
| 12 | first wall |
| 14 | second wall |
| 16 | elongated member |

-continued

ELEMENT LIST

| Element Symbol | Element Name |
|---|---|
| 18 | bottom end |
| 20 | top end |
| 22 | plurality of tubes |
| 24 | outside tubes |
| 26 | middle tubes |
| 28 | head-plate |
| 30 | first triangular shaped gusset |
| 32 | attachment |
| 34 | retention finger |
| 36 | flange |
| 38 | second triangular shaped gusset |
| 40 | guide member |
| 42 | collar |
| 44 | catch |
| 46 | plurality of side-plates |
| 48 | adjustable connection |
| 50 | catch flanges |
| 52 | top catch holes |
| 54 | bottom catch holes |
| 56 | collar flanges |
| 58 | first top collar holes |
| 60 | first bottom collar holes |
| 62 | top pin |
| 64 | bottom pin |
| 66 | second top collar holes |
| 68 | second bottom collar holes |
| 70 | hook portion |
| F | force |

What is claimed is:

1. A panel pushing assembly (10) for pushing a first wall (12) into the ground of a slide rail system having a second wall (14) comprising;

an elongated member (16) having a longitudinal axis extending between a bottom end (18) for engaging the top of the first wall (12) and a top end (20) for receiving a pushing force (F), a guide member (40) for engaging the top of the second wall (14) and slidable along said elongated member (16) for guiding longitudinal movement of said elongated member (16) in response to the pushing force (F) being applied to said top end (20) of said elongated member (16) to push the first wall (12) into the ground, and said assembly (10) characterized by said guide member (40) including an adjustable connection (48) for adjusting said guide member (40) radially relative to said elongated member (16) to accommodate second walls (14) having different widths.

2. An assembly (10) as set forth in claim 1 wherein said guide (40) includes a catch (44) extending radially of said longitudinal axis in a transverse direction for engaging the top of the second wall (14).

3. An assembly (10) as set forth in claim 2 wherein said catch (44) includes a hook portion (70) extending downwardly to overlap the second wall (14) for preventing radial movement of said elongated member (16) relative to the second wall (14).

4. An assembly (10) as set forth in claim 3 wherein said guide (40) includes a collar (42) disposed about and slidable along said elongated member (16) and said catch (44) extends radially from said collar (42).

5. An assembly (10) as set forth in claim 4 wherein said adjustable connection (48) interconnects said catch (44) and said collar (42) for adjusting said catch (44) radially relative to said collar (42) to accommodate second walls (14) having different widths.

6. An assembly (10) as set forth in claim 5 wherein said adjustable connection (48) includes:

a pair of catch flanges (50) spaced from one another along said transverse direction and extending parallel to one another from said catch (44);

each of said catch flanges (50) defining a top catch hole (52) and a bottom catch hole (54);

said top catch holes (52) being axially aligned with one another and said bottom catch holes (54) being axially aligned with one another;

a pair of collar flanges (56) spaced from one another in said transverse direction and extending parallel to one another from said collar (42) for overlapping said catch flanges (50);

each of said collar flanges (56) defining a first top collar hole (58) and a first bottom collar hole (60);

said first top collar holes (58) being axially aligned with one another and said bottom collar holes (60, 68) being axially aligned with one another;

said adjustable connection (48) including a top pin (62) and a bottom pin (64);

said top pin (62) being disposed through said first top collar holes (58) and said top catch holes (52) for interconnecting said catch (44) and said collar (42); and said bottom pin (64) being disposed through said first bottom collar holes (60) and said bottom catch holes (54) for restricting rotational movement of said catch (44) relative to said collar (42).

7. An assembly (10) as set forth in claim 6 wherein:

each of said collar flanges (56) define a second top collar hole (66) and a second bottom collar hole (68);

said second top collar holes (66) are laterally aligned with one another and radially spaced in a transverse direction from said first top collar holes (58); and said second bottom collar holes (68) are laterally aligned with one another and radially spaced in a transverse direction from said first top collar holes (58).

8. An assembly (10) as set forth in claim 3 wherein said catch (44) and said hook portion (70) extend radially of said longitudinal axis in a lateral direction outwardly of said elongated member (16) for extending along and engaging the second wall (14).

9. An assembly (10) as set forth in claim 3 including a retention finger (34) disposed on and extending downwardly from said bottom end (18) of said elongated member (16) for disposition between the walls (12, 14) for engaging the interior of the first wall (12) to prevent lateral movement of said bottom end (18) off of the top of the first wall (12).

10. An assembly (10) as set forth in claim 9 including a head-plate (28) disposed on and extending radially both transversely and laterally from said top end (20) of said elongated member (16) for receiving the force (F).

11. An assembly (10) as set forth in claim 10 including a plurality of first triangular shaped gussets (30) disposed under said head-plate (28) and interconnecting said elongated member (16) and said head-plate (28).

12. An assembly (10) as set forth in claim 11 including an attachment (32) for lifting said assembly (10) and defined by one of said gussets (30, 38) having a through-hole.

13. An assembly (10) as set forth in claim 9 including a flange (36) disposed under said bottom end (18) of said elongated member (16) and supporting said retention finger (34) along side of said elongated member (16).

14. An assembly (10) as set forth in claim 13 including a plurality of second triangular shaped gussets (38) disposed on said flange (36) and interconnecting said flange (36) and said elongated member (16).

15. An assembly (10) as set forth in claim 9 including an attachment (32) disposed adjacent to said top end (20) of said elongated member (16) for lifting said assembly (10).

16. An assembly (10) as set forth in claim 3 wherein said elongated member (16) comprises a plurality of tubes (22) abutting one another to define a cross section having a rectangular periphery.

17. An assembly (10) as set forth in claim 16 wherein said guide (40) includes a collar (42) disposed about and slidable along said elongated member (16) and said catch (44) extends radially from said collar (42) and said collar (42) includes a plurality of side-plates (46) for engaging said rectangular periphery of said plurality of tubes (22) of said elongated member (16).

18. A panel pushing assembly (10) for pushing the first wall (12) into the ground of a slide rail system having a second wall (14) comprising;

an elongated member (16) having a longitudinal axis extending between a bottom end (18) and a top end (20) said elongated member (16) comprising a plurality of tubes (22) abutting one another to define a cross section having a rectangular periphery, a head-plate (28) disposed on and extending radially both transversely and laterally from said top end (20) of said elongated member (16) for receiving the force (F), a plurality of first triangular shaped gussets (30) disposed under said head-plate (28) and interconnecting said elongated member (16) and said head-plate (28), an attachment (32) for lifting said assembly (10) and defined by one of said first gussets (30) having a through-hole, a retention finger (34) disposed on and extending downwardly from said bottom end (18) of said elongated member (16) for disposition between the walls (12, 14) for engaging the interior of the first wall (12) to prevent radial movement of said bottom end (18) off of the top of the first wall (12), a flange (36) disposed under said bottom end (18) of said elongated member (16) and supporting said retention finger (34) along side of said elongated member (16), a plurality of second triangular shaped gussets (38) disposed on said flange (36) and interconnecting said flange (36) and said elongated member (16), a guide member (40) for engaging the top of the second wall (14) and guiding longitudinal movement of said elongated member (16) in response to the pushing force (F) being applied to said top end (20) of said elongated member (16) to push the first wall (12) into the ground, wherein said guide (40) includes a collar (42) disposed about and slidable along said elongated member (16) and a catch (44) extending radially of said longitudinal axis in a transverse direction for engaging the top of the second wall (14) said collar (42) including a plurality of side-plates (46) engaging said elongated member (16) said catch (44) having a hook portion (70) extending downwardly for preventing radial movement of said elongated member (16) relative to the second wall (14), wherein said catch (44) and said hook portion (70) extend radially of said longitudinal axis in the lateral direction outwardly of said elongated member (16) for extending along and engaging the second wall (14);

an adjustable connection (48) interconnecting said catch (44) and said collar (42) for adjusting said catch (44) radially relative to said collar (42) to accommodate second walls (14) having different widths;

wherein said adjustable connection (48) includes a pair of catch flanges (50) spaced from one another along said transverse direction and extending parallel to one another from said catch (44) and a pair of collar flanges (56) spaced from one another in said transverse direction and extending parallel to one another from said collar (42) for overlapping said catch flanges (50);

each of said catch flanges (50) defining a top catch hole (52) and a bottom catch hole (54);

said top catch holes (52) of said catch flanges (50) being axially aligned with one another and said bottom catch holes (54) being axially aligned with one another;

each of said collar flanges (56) defining a first top collar hole (58) and a first bottom collar hole (60);

said first top collar holes (58) of said collar flanges (56) being axially aligned with one another and said bottom collar holes (60, 68) being axially aligned with one another;

said adjustable connection (48) including a top pin (62) and a bottom pin (64);

said top pin (62) being removably disposed through said first top collar holes (58) and said top catch holes (52) for interconnecting said catch (44) and said collar (42);

said bottom pin (64) being removably disposed through said first bottom collar holes (60) and said bottom catch holes (54) for restricting rotational movement of said catch (44) relative to said collar (42);

each of said collar flanges (56) define a second top collar hole (66) and a second bottom collar hole (68);

said second top collar holes (66) are laterally aligned with one another and radially spaced in a transverse direction from said first top collar holes (58); and said second bottom collar holes (68) are laterally aligned with one another and radially spaced in a transverse direction from said first top collar holes (58).

19. A method of pushing the first wall (12) of a slide rail system having a second wall (14) comprising the steps of;

resting an elongated member (16) on the top of the first wall (12), applying a downward force (F) to the top of the elongated member (16), transmitting the downward force (F) to the top of the first wall (12), moving the first wall (12) in a longitudinal direction, placing a guide member (40) on the second wall (14) and guiding sliding longitudinal movement of the elongated member (16) relative to the guide (40), and said method characterized by adjusting the guide member (40) radially relative to the elongated member (16) to accommodate the width of the second wall (14).

* * * * *

UNITED STATES PATENT AND TRADEMARK OFFICE

CERTIFICATE OF CORRECTION

PATENT NO. : 7,651,300 B2
APPLICATION NO. : 11/508663
DATED : January 26, 2010
INVENTOR(S) : Gary Richard Carlson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 657 days.

Signed and Sealed this

Twenty-third Day of November, 2010

David J. Kappos

David J. Kappos
*Director of the United States Patent and Trademark Office*